United States Patent [19]

Forrest et al.

[11] 4,234,186

[45] Nov. 18, 1980

[54] BOARD GAME

[75] Inventors: Stanley G. Forrest; Michael C. Spashett, both of Southampton, England

[73] Assignee: Guy Colins Co. Limited, Southampton, England

[21] Appl. No.: 937,605

[22] Filed: Aug. 28, 1978

[30] Foreign Application Priority Data

Feb. 14, 1978 [GB] United Kingdom ..... 5864/78

[51] Int. Cl.[2] ..... A63F 3/00

[52] U.S. Cl. ..... 273/243; 273/274

[58] Field of Search ..... 273/236, 243, 256

[56] References Cited

U.S. PATENT DOCUMENTS

| | | | |
|---|---|---|---|
| 3,033,572 | 5/1962 | Thibault | 273/243 |
| 3,163,423 | 12/1964 | Jackson | 273/256 |
| 3,759,520 | 9/1973 | Straitwell | 273/243 |
| 3,889,954 | 6/1975 | Masilow | 273/274 |
| 3,913,919 | 10/1975 | Carpenter | 273/274 |
| 4,032,154 | 6/1977 | Magiera | 273/256 |

FOREIGN PATENT DOCUMENTS

| | | | |
|---|---|---|---|
| 1345245 | 1/1974 | United Kingdom | 273/243 |
| 1357363 | 6/1974 | United Kingdom | 273/257 |
| 1395140 | 5/1975 | United Kingdom | 273/256 |
| 1396079 | 5/1975 | United Kingdom | 273/256 |
| 1426664 | 3/1976 | United Kingdom | 273/256 |
| 1439149 | 6/1976 | United Kingdom | 273/256 |
| 1479092 | 2/1977 | United Kingdom | 273/244 |

*Primary Examiner*—Richard C. Pinkham
*Assistant Examiner*—R. Carl Moy
*Attorney, Agent, or Firm*—Young & Thompson

[57] ABSTRACT

A board game has a square board marked at its periphery into playing locations serially extending along a closed-circuit single-lane track. Centrally the board is marked to receive five groups of playing cards and a money deposit. Dice are used to determine the movement of playing tokens from one playing location to another. The playing locations are associated with the award of money prizes or playing cards and collection by a player of a predetermined set of cards ends the game.

7 Claims, 2 Drawing Figures

BOARD GAME

Figure 2:
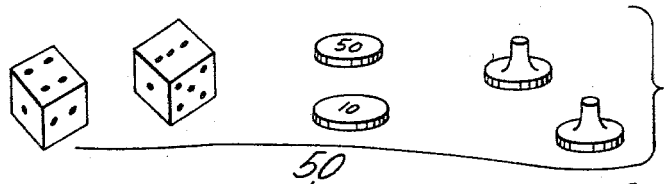

This invention relates to game apparatus, and in particular to apparatus for playing a board game representative of the play of a fruit machine.

A board game apparatus representative of the play of a fruit machine is described in British Pat. No. 1,345,245 to Ferguson. The Ferguson apparatus comprises a board bearing a representation of a closed-circuit three-lane playing track having each lane transversely subdivided into sixty-three playing spaces each bearing one of a plurality of different indicia. The playing track encloses on the board a chart identifying predetermined winning combinations of indicia selected one from the indicia of each lane and associates with these award of money symbols. The construction of the board is such that each lane has a distinctive background colour, and the colours of the indicia, which appear on all three lanes, have to be distinguished therefrom. In addition, playing pieces are provided for movement along the lanes, a set of three playing pieces for each player, and each set is distinguished from the others by colour. The manufacture of the very complex board of the Ferguson specification is very time-consuming and expensive. In addition, players of the game find it difficult to quickly identify whether they have won an award, since the playing location of each playing piece of their sets have to be noted and then the combination of corresponding indicia compared with the chart.

It is an object of the present invention to provide board game apparatus that allows a simplified game to be played based on the play of a fruit machine.

It is another object of the present invention to provide board game apparatus that is comparatively cheap to manufacture.

It is an important feature of the apparatus that a first plurality of playing locations marked on the board or other playing surface each bears a plurality of indicia, awards, preferably money or money symbols, being given in response to a playing piece being moved to one of the locations.

The pieces are moved between playing locations thereby to amass money and/or tokens for respective players of the game until one of the players has collected a predetermined set of tokens. That player is declared the winner and receives a money symbol or other "jackpot" or prize contributed to initially by the players and/or during play.

The plurality of tokens may be divided into two or more, and preferably four, groups, and the said set of tokens may then comprise one token from each group. Preferably each group of tokens is associated with one respective location of the playing surface, for example the corner playing locations of a square or rectangular board.

Other playing locations are preferably associated with the award of tokens, preferably cards, and the board is marked to show deposit areas for said tokens.

The designation of the deposit areas may take the form of marking of the playing surface of the board, or an indentation of or extension away from the plane of the board so as to provide a physical boundary for the cards.

The playing surface preferably is marked to show a "jackpot", which can be awarded in response to the collection of a predetermined set of said tokens.

A feature of the invention is the provision of apparatus including a playing surface marked to have a closed-circuit single-lane track with playing locations marked transversely thereof.

Preferably the board is substantially square and the playing locations are marked thereon around the edges of the board. The areas designated for the groups of cards may conveniently be located in close proximity to their respective playing locations.

The game is preferably played with symbolic money, as opposed to legal tender, and this may be provided with the game as notes and coins of various suitable denominations. A receptacle may be provided for the, or each, jackpot and this may conveniently form part of the board, for example by being mounted thereon or therein.

It is envisaged that the individual ones of said first plurality of the playing locations be identified by combinations of characters, such as lemons, plums, cherries etc.

Figure 1:
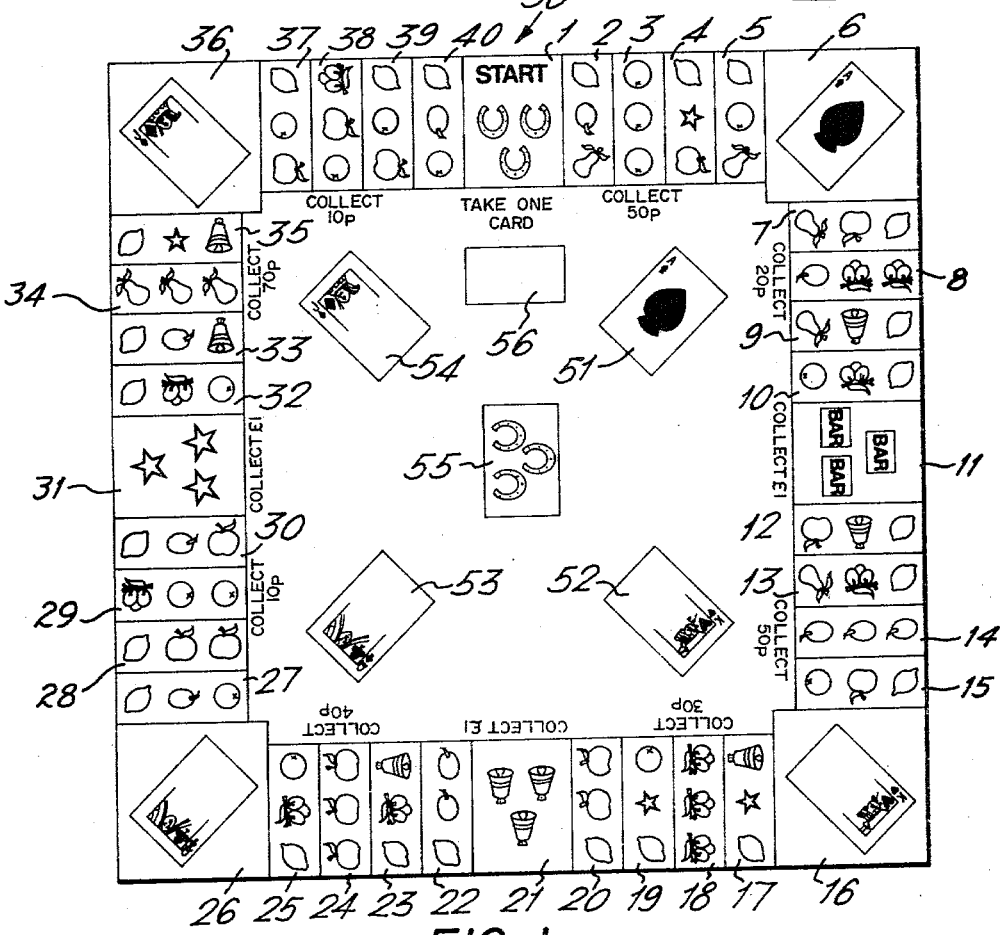

A board game in accordance with the present invention will now be described, by way of example, with reference to the accompanying drawing, in which:

FIG. 1 is a plan view of a game board in accordance with the present invention; and FIG. 2 is a perspective view of dice, playing pieces, and money symbols, for use with the board of FIG. 1.

A square board 50 is divided around its edge into forty playing locations together with a START location. The playing locations are numbered 1 to 40, and are distinguished by the pictorial representations thereon in accordance with the following Key, which also denotes a prize in the form of a card or money associated with some of the locations:

KEY TO THE BOARD

| Playing location | Pictorial Representation | | | Prize |
|---|---|---|---|---|
| 1. | Start | Three Horseshoes | | Horseshoe Card |
| 2. | Lemon | Plum | Pear | 0 |
| 3. | Orange | Orange | Orange | 60p |
| 4. | Lemon | Star | Apple | 0 |
| 5. | Lemon | Orange | Pear | 0 |
| 6. | | ACE | | Ace Card |
| 7. | Lemon | Apple | Pear | 0 |
| 8. | Cherry | Cherry | Plum | 20p |
| 9. | Lemon | Bell | Pear | 0 |
| 10. | Lemon | Cherry | Orange | 0 |
| 11. | Bar | Bar | Bar | £1 |
| 12. | Lemon | Bell | Apple | 0 |
| 13. | Lemon | Cherry | Pear | 0 |
| 14. | Plum | Plum | Plum | 50p |
| 15. | Lemon | Apple | Orange | 0 |
| 16. | | KING | | King Card |
| 17. | Lemon | Star | Bell | 0 |
| 18. | Cherry | Cherry | Cherry | 30p |
| 19. | Lemon | Star | Orange | 0 |
| 20. | Lemon | Apple | Apple | 0 |
| 21. | Bell | Bell | Bell | £1 |
| 22. | Lemon | Plum | Plum | 0 |
| 23. | Lemon | Cherry | Bell | 0 |
| 24. | Apple | Apple | Apple | 40p |
| 25. | Lemon | Cherry | Orange | 0 |
| 26. | | QUEEN | | Queen Card |
| 27. | Lemon | Plum | Orange | 0 |
| 28. | Lemon | Apple | Apple | 0 |
| 29. | Cherry | Orange | Orange | 10p |
| 30. | Lemon | Plum | Apple | 0 |
| 31. | Star | Star | Star | £1 |
| 32. | Lemon | Cherry | Orange | 0 |
| 33. | Lemon | Plum | Bell | 0 |
| 34. | Pear | Pear | Pear | 70p |
| 35. | Lemon | Star | Bell | 0 |
| 36. | | JACK | | Jack Card |

-continued

KEY TO THE BOARD

| Playing location | Pictorial Representation | | | Prize |
|---|---|---|---|---|
| 37. | Lemon | Orange | Apple | 0 |
| 38. | Cherry | Apple | Orange | 10p |
| 39. | Lemon | Orange | Apple | 0 |
| 40. | Lemon | Plum | Orange | 0 |

The key may be provided as a chart separate from the board, or may be marked on the board. Alternatively, the prizes associated with each playing location may be marked on the board adjacent, for example peripherally outwardly of, the respective locations.

As can be seen from the Key, those playing locations having a lemon symbol thereon do not give rise to the award of any prize.

It is seen that playing locations 6, 16, 26 and 36 are represented by an Ace, King, Queen and Jack respectively, and four groups of cards, 51, 52, 53 and 54 bearing corresponding representations are associated with respective ones of these playing locations. A further group of cards 55, bearing the representation of three horseshoes is associated with playing location 1. The groups of cards are placed at respective designated areas of the board 50, and these areas may be defined by raised portions of the board's surface.

Playing the game involves the deposition of money in, and the withdrawal of money from, a jackpot, and although no special receptacle need be provided for this money, it is found convenient to provide a receptacle, or designated area, for this on the board 50, for example the area 56 bounded by a raised portion of the playing surface of the board 50.

The game may be played by any number of players, generally two to six, and preferably four. The playing pieces 57 are arranged on the START location at the outset of the game. Six of each of the Ace, King, Queen and Jack cards are provided, and thirteen Horseshoe cards, and these are placed at their respective locations on the central portion of the board 50. Token money 58 totalling £200 in notes and coins is provided, and the players are provided with equal amounts at the outset of the game. If there are four players, each player is provided with £50 worth of notes and coins, subdivided into five £5 notes, fifteen £1 notes, ten 50p pieces, and fifty 10p pieces. A similar cash distribution for other numbers of players may easily be calculated, and it will be appreciated that for certain numbers there will be a residue. For six players, for example, the distribution will be three £5 notes, nine £1 notes, six 50p pieces and thirty 10p pieces to each player leaving a residue of £20. This may conveniently be added to the jackpot 56.

The game is played as follows. Each player selects a playing piece 57. The order of play is determined by a preliminary throw of the dice 59, the highest number being the starter. Play takes place clockwise around the board. Each player contributes £5 to the jackpot 56 at the outset, and also 10p each time he throws the dice.

The players throw the dice in turn and move their pieces 57 around the board in accordance therewith. If a player lands on any of squares 6, 16, 26 or 36, he picks up the card from the corresponding group 51, 52, 53 or 54 and retains this. A player may only retain one card from each group. If a playing piece reaches location 1, then the player collects one horseshoe card from the group 55. On collection of three horseshoe cards, the player takes a prize of £5 from the jackpot 56. Should a player land on any of the other playing locations, then each of the other players pays to him the prize indicated thereon as indicated by the Key above.

The player who first collects one card from each of the groups 51, 52, 53 and 54 is the winner of the game and collects all the money from the jackpot 56.

At the end of a game, all cards are returned to their respective groups on the board, and each player starts the next game with the amount of money that he has at the end of the preceding game. There is not a reissue of the 50 cash, so that when a player loses all his money he is out of the game, unless a loan can be negotiated from other players.

We claim:

1. Apparatus for playing a game, comprising a plurality of tokens, a board bearing a closed-circuit single-lane track that is sub-divided transversely into a series of playing locations extending around the track, each of a first plurality of said playing locations portraying three fruit machine symbols, said fruit machine symbols being selected from several different fruit machine symbols and adjacent said locations bearing different combinations of said fruit machine symbols, and each of a second plurality of said playing locations portraying one of said tokens, a playing piece for each player, said pieces being movable along said track in accordance with predetermined rules, and aleatory means for determining to which playing location a player moves his playing piece at his turn to play, and a plurality of money symbols, wherein said money symbols are associated with said first plurality of playing locations according to the absence of a given said fruit machine symbol and are awardable to a player whose playing piece attains one of said first plurality of playing locations, and said tokens are awardable to a player whose playing piece attains one of said second plurality of playing locations.

2. Apparatus according to claim 1, in which said given fruit machine symbol is a lemon and said money symbols are present at only those playing locations that do not display a lemon.

3. A board game according to claim 1, wherein said aleatory means comprises a pair of dice.

4. Apparatus according to claim 1, the board being rectangular and portraying a different said token in each ot its four corners, the board having marked thereon the same four different tokens inwardly of said track each adjacent its associated said corner, said tokens comprising four stacks of cards one lying atop each said token marking inwardly of said track, the cards in each said stack all depicting their underlying token that is marked on the board.

5. Apparatus according to claim 4, one of said playing locations between two of said corners bearing a symbol repeated a plurality of times, the board having marked thereon inwardly of said track a group comprising the same plurality of the last-named symbol, and a further stack of identical cards each bearing the same plurality of the last-named symbol and lying atop said group on the board.

6. Apparatus according to claim 4, said cards being conventional playing cards.

7. Apparatus according to claim 6, said cards being aces, kings, queens and jacks.

* * * * *